US006677094B2

(12) United States Patent
Mita

(10) Patent No.: US 6,677,094 B2
(45) Date of Patent: Jan. 13, 2004

(54) TONER FOR NON-MAGNETIC MONOCOMPONENT DEVELOPMENT

(75) Inventor: Takahiro Mita, Shizuoka (JP)

(73) Assignee: Tomoegawa Paper Co., Ltd., Tokyo (JP)

( * ) Notice: Subject to any disclaimer, the term of this patent is extended or adjusted under 35 U.S.C. 154(b) by 0 days.

(21) Appl. No.: 10/105,259

(22) Filed: Mar. 26, 2002

(65) Prior Publication Data

US 2003/0031945 A1 Feb. 13, 2003

(30) Foreign Application Priority Data

Mar. 28, 2001 (JP) ..... P2001-091841

(51) Int. Cl.[7] ..... G03G 9/097

(52) U.S. Cl. ..... 430/108.2; 430/108.3; 430/108.7

(58) Field of Search ..... 430/108.3, 108.2, 430/108.7, 108.6

(56) References Cited

U.S. PATENT DOCUMENTS

| | | | | | |
|---|---|---|---|---|---|
| 5,486,420 | A | * | 1/1996 | Nishihara et al. | 428/405 |
| 5,763,229 | A | | 6/1998 | Kobayashi et al. | 430/108.6 |
| 5,800,959 | A | | 9/1998 | Ikami | 430/126 |
| 5,914,210 | A | * | 6/1999 | Demizu et al. | 430/108.6 |
| 6,117,607 | A | * | 9/2000 | Shimizu et al. | 430/108.7 |
| 6,232,030 | B1 | * | 5/2001 | Otani et al. | 430/137.18 |
| 6,503,677 | B1 | * | 1/2003 | Gutman et al. | 430/108.3 |
| 2002/0086228 | A1 | * | 7/2002 | Koumura | 430/108.3 |

FOREIGN PATENT DOCUMENTS

| | | |
|---|---|---|
| JP | 2-163760 | 6/1990 |
| JP | 2-300763 | 12/1990 |
| JP | 4-119361 | 4/1992 |
| JP | 4-152354 | 5/1992 |
| JP | 5-053369 | 3/1993 |
| JP | 5-346682 | 12/1993 |
| JP | 10-39534 | 2/1998 |
| JP | 11-202546 | 7/1999 |

* cited by examiner

*Primary Examiner*—Janis L. Dote
(74) *Attorney, Agent, or Firm*—Nixon & Vanderhye P.C.

(57) ABSTRACT

By reducing non-transferred toner on a photosensitive member, image density is sufficiently maintained and fogging in the non-imaged portion is prevented. The developing agent for non-magnetic monocomponent development is a toner comprising toner particles and an external additive adhered on the surface of the toner particles, wherein the external additive comprises inorganic fine particles (A), which are surface-treated with aminosilane and dimethylpolysiloxane and have a polarity reverse to that of the toner, and inorganic fine particles (B) having the same polarity as that of the toner.

4 Claims, No Drawings

TONER FOR NON-MAGNETIC MONOCOMPONENT DEVELOPMENT

BACKGROUND OF THE INVENTION

1. Field of the Invention

The present invention relates to a toner for non-magnetic monocomponent development which is employed to develop an electrostatic image formed using electrophotographic methods, electrostatic recording methods, and electrostatic printing methods.

2. Description of Related Art

Examples of developing methods, which have been conventionally employed in electrophotographic methods include a two-component developing method and a monocomponent developing method. The two-component developing method is a method of charging insulating fine powders containing a binder resin as a main component, that is, an insulating toner and a magnetic carrier, to form a magnetic brush by friction, and developing an electrostatic latent image formed on a photosensitive member by using the magnetic brush. The monocomponent developing method can be further classified into a magnetic monocomponent developing method and a non-magnetic monocomponent developing method. The magnetic monocomponent developing method is a method of developing using a toner for magnetic monocomponent development, whereas the non-magnetic monocomponent developing method is a method of forming a toner for non-magnetic monocomponent development on a developing roller in the form of a thin layer and developing with or without contacting with a photosensitive member.

In particular, the non-magnetic monocomponent developing method, among these developing methods, requires that the toner for non-magnetic monocomponent development should be charged with a sufficient charge amount equivalent to the two-component developing method in order to obtain a good image without carrier. It is indispensable to uniformly control the thickness of the toner layer on the developing roller.

To provide toner particles with a sufficient charge amount or to uniformly control the thickness of the toner layer, a rubber or metal blade member is used by being press-contacted with the developing roller at present. There is proposed a technique of charging a conventional toner for non-magnetic monocomponent development with a relatively high charge amount by using a binder resin such as styrene-acrylic copolymer resin and a colorant as main components and mixing them with a charge control agent such as metal-containing azo dye.

However, a conventional toner for non-magnetic monocomponent development has a problem in that a large amount of an untransferred toner remains on a photosensitive member. When a large amount of the untransferred toner remains on the photosensitive member, a decrease in image density occurs. In a method having a photosensitive member cleaning mechanism, a filming phenomenon also arises wherein a toner is deposited and fused on the surface of a photosensitive member due to a cleaning member press-contacted with the photosensitive member, and/or consumption of the toner is sometimes increased. In a method in which no photosensitive member cleaning mechanism is used, after the toner is transferred onto a transfer medium since the photosensitive member is discharged in the state where the untransferred toner is remaining, and is then charged directly by a charging member, ghosting sometimes appears in a cycle corresponding to the circumference of the photosensitive member as a result of the occurrence of a difference in charge amount between the portion where the untransferred toner remains and the portion where the untransferred toner does not remain.

As used herein, "ghosting" refers to a phenomenon wherein, if a part of developed toner remains on the photosensitive member without being transferred in a previous printing cycle, the light density image remaining from the previous printing cycle appears in light-tone portions, such as non-image or half-tone portions in a new image in a cycle corresponding to the circumference of the photosensitive member, as a result of the occurrence of a difference in charge amount between the remained image portion of the previous cycle and the non-image portion of new cycle.

To solve these problems, as disclosed in Japanese Unexamined Patent Application, First Publication No. Hei 11-202546, it has conventionally been proposed to improve the peelability of a toner from a photosensitive member by applying silicone oil to the surface of toner particles. It has also been proposed that the surface of inorganic fine particles such as silica particles is treated with silicone oil and the treated particles are applied on the surface of the toner particles, thereby to control the charging property and fluidity and to improve the transfer property.

However, none of these methods could sufficiently prevent the untransferred toner from remaining on the surface of the photosensitive member. It was difficult for an apparatus having no cleaning mechanism, which has attracted special interest recently in view of size reduction of the apparatus and avoiding of photosensitive member abrasion, to prevent ghosting from occurring.

In the conventional method of controlling the thickness of a toner layer on the surface of a developing roller thinly and uniformly, aminosilanes, and especially amino-modified silicone oil for imparting the transferrability, are used as a treating agent for inorganic fine particles having a reverse polarity in the case of a negatively chargeable toner. The treating agent having an amino group has a problem in that the charging property drastically varies between high temperature/high humidity environments and low temperature/low humidity environments because of its weak hydrophobicity as compared with a methyl group.

BRIEF SUMMARY OF THE INVENTION

In light of the above-described problems in conventional toners for non-magnetic monocomponent development, the present invention has been made, and an object thereof is to provide a toner for non-magnetic monocomponent development, which sufficiently maintains the image density and prevents fogging in the non-image portion by reducing the untransferred toner on a photosensitive member, and does not produce ghosting when applied to a non-magnetic monocomponent developing device having no cleaning mechanism.

The present invention is directed to a toner for non-magnetic monocomponent development, comprising toner particles and an external additive adhered on the surface of the toner particles, wherein the external additive comprises inorganic fine particles (A), which are surface-treated with aminosilane and dimethylpolysiloxane and have a polarity opposite to that of the toner, and inorganic fine particles (B) having the same polarity as that of the toner.

As the inorganic fine particles (A), silica particles (A') having a polarity opposite to that of the toner can be employed. As the inorganic fine particles (B), silica particles (B') having the same polarity as that of the toner can be employed.

A BET specific surface area of the silica particles (A') is preferably within a range from 40 to 90 $m^2/g$, and a BET specific surface area of the silica particles (B') is preferably within a range from 100 to 300 $m^2/g$.

A weight ratio of the silica particles (A') to the silica particles (B') is preferably within a range from 10:90 to 50:50.

According to the present invention, it is possible to control the amount of the developing toner, in other words, the amount of toner consumed, to be the minimum necessary, and to reduce the untransferred toner on a photosensitive member by adhering an external additive using inorganic fine particles having the same polarity as that of the toner in combination with inorganic fine particles having a polarity opposite to that of the toner on toner particles. Consequently, the present invention exerts an effect capable of preventing the occurrence of surface fogging of the photosensitive member due to poor cleaning in the case of a device having a cleaning mechanism, and capable of preventing the occurrence of ghosting in the case of a device having no cleaning mechanism.

DETAILED DESCRIPTION OF THE INVENTION

The present invention will now be described in detail.

The toner particles in the present invention comprise at least a binder resin and a colorant, and are produced by appropriately mixing them with anti-offset agents such as polypropylene or polyethylene, charge control agents, and lubricants for modifying fluidity in a dispersed state, and using a melt-kneading-pulverizing method or a polymerization method.

Various known resins can be used as the binder resin, and examples thereof include styrene copolymers such as polystyrene, poly-p-chlorostyrene, poly-α-methylstyrene, styrene-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-propyl acrylate copolymer, styrene-butyl acrylate copolymer, styrene-octyl acrylate copolymer, styrene-methyl methacrylate copolymer, styrene-ethyl methacrylate copolymer, styrene-propyl methacrylate copolymer, styrene-butyl methacrylate copolymer, styrene-α-chloromethyl methacrylate copolymer, styrene-acrylonitrile copolymer, styrene-vinyl methyl ether copolymer, styrene-vinyl ethyl ether copolymer, styrene-vinyl ethyl ketone copolymer, styrene-butadiene copolymer, styrene-acrylonitrile-indene copolymer, styrene-maleic acid copolymer, and styrene-maleate ester; polymethyl methacrylate, polyethyl methacrylate, polybutyl methacrylate, copolymer thereof, polyvinyl chloride, polyvinyl acetate, polyethylene, polypropylene, polyester, polyurethane, polyamide, epoxy resin, polyvinyl butyral resin, rosin, modified rosin, terpene resin, phenol resin, aliphatic or alicyclic hydrocarbon resin, aromatic petroleum resin, chlorinated paraffin, and paraffin wax. These binder resins can be used alone or in combination.

Examples of the colorant include carbon black, aniline black, aniline blue, chalcoil blue, chrome yellow, ultramarine blue, Dupont oil red, quinoline yellow, methylene blue chloride, phthalocyanine blue, malachite green oxalate, lamp black, rose bengale, rhodamine dyes or pigments, anthraquinone dyes, monoazo and disazo dyes, and quinacridone magenta pigment. It is necessary that these colorants be mixed in an amount sufficient to form a visible image having a sufficient density.

When the colorant is carbon black, carbon black having a primary particle diameter within a range from 25 to 70 nm, particularly from 30 to 55 nm, and a specific surface area of 110 $m^2/g$ or less, is preferably employed. When using such a carbon black, the dispersibility with other materials in a melt kneading method and the grindability are superior.

The amount of the colorant may be an amount sufficient to color a toner capable of forming a visible image by the development and is preferably within a range from 2 to 20 parts by weight based on 100 parts by weight of the binder resin. When the amount is less than 2 parts by weight, the coloring effect is insufficient. On the other hand, when the amount is more than 20 parts by weight, the image density is saturated while performances of the toner are lowered; for example, the electric resistance of the toner is lowered, the triboelectric charge amount becomes insufficient, and surface fogging occurs.

The toner particles constituting the present invention may contain other additives, for example, charge control agents and releasing agents. Examples of the charge control agent include metal-containing azo dyes, salicylic acid metal complexes, nigrosine dyes, quaternary ammonium salts, triphenylmethane control agents, oil-soluble dyes such as oil black; naphthenic acid, salicylic acid, octylic acid, or metal salt thereof such as manganese, cobalt, iron, zinc, aluminum, or lead salt; and alkyl salicylic acid metal chelates.

In the toner particles constituting the present invention, when using releasing agents (lubricants) as the other additives, examples thereof include polyalkylene wax such as low-molecular polypropylene or low-molecular polyethylene, paraffin wax, higher fatty acid, and fatty acid amide. The addition amount is preferably within a range from 0.1 to 5 parts by weight based on 100 parts by weight of the binder resin. The method of mixing charge control agents and releasing agents with the toner includes, for example, an internal addition method of adding to the interior of the toner and a method of adhering on the surface of the toner particles, and an internal addition method is generally employed. To prevent deterioration of developing properties by protecting the photosensitive member to obtain a high quality image, higher fatty acid and a metal salt thereof may be appropriately added.

The toners for non-magnetic monocomponent development of the present invention are formed by applying an external additive composed of at least two kinds of the following inorganic fine particles on the surface.

Inorganic fine particles (A): which are surface-treated with aminosilane and dimethylpolysiloxane and have a polarity opposite to that of a toner for non-magnetic monocomponent development.

Inorganic fine particles (B): which have the same polarity as that of a toner for non-magnetic monocomponent development.

In this case, the material of particles includes silica, titanium oxide, zinc oxide, strontium titanate and calcium carbonate, and silica is preferably employed in view of the fluidity of toner particles.

In the present invention, for "surface-treating with aminosilane and dimethylpolysiloxane", a wide variety of treatment processes can be employed, and either a dry process or a wet process may be employed. For example, the inorganic fine particles (A) and predetermined amounts of aminosilane and dimethylpolysiloxane are put into a mixing machine such as a Henschel mixer or a ball mill to carry out dry mixing; or aminosilane and dimethylpolysiloxane are dissolved in an appropriate solvent, the solution is then mixed with the inorganic fine particles (A) which are added to the solution, and the solvent is removed.

A relationship between the charge polarity of the toner for non-magnetic monocomponent development of the present invention and the charge polarity of inorganic fine particles (A) and (B) constituting the external additive will now be described.

When Toner for Non-magnetic Monocomponent Development has Negative Polarity

The inorganic fine particles (A) are controlled to be positively chargeable, which is reverse to the polarity of the toner, by controlling a quantitative relationship between aminosilane and dimethylpolysiloxane so that the amount of aminosilane is present in an excess amount. The quantitative relationship between the two varies depending on the kind of the surface treating agent and the triboelectric charge amount of inorganic fine particles. When the amount of dimethylpolysiloxane is too small, the effect for use as the surface treating agent is lost, taking the easiness of treating the treating agent and uniformity into consideration. Therefore, the amount of dimethylpolysiloxane is preferably within a range from 5 to 50% by weight based on the total weight of the two.

Simultaneously, the inorganic fine particles (B) are controlled to be negatively chargeable by treating the surface of the inorganic fine particles using a surface treating agent, for imparting a negative polarity, such as dimethylpolysiloxane, hexamethylsusilazane or dimethylchlorosilane.

In this case, the inorganic fine particles (B) have a function of charging the toner and imparting the fluidity to the toner, while the inorganic fine particles (A) have a function of inhibiting excess charging of the toner, resulting in a decrease in the amount of the toner deposited on the surface of the photosensitive member by development, and improving the transfer property and a decrease in the amount of untransferred toner.

In Case Toner for Non-magnetic Monocomponent Development has positive polarity

The inorganic fine particles (A) are controlled to be negatively chargeable, which is reverse to the polarity of the toner, by controlling a quantitative relation between aminosilane and dimethylpolysiloxane so that the amount of dimethylpolysiloxane is an excess amount. With respect to the quantitative relation between the two, when the amount of aminosilane is too small, the effect for use as the surface treating agent is lost, similar to the case of the toner having a negative polarity. Therefore, the amount of aminosilane is preferably within a range from 5 to 50% by weight based on the total weight of the two.

Simultaneously, the inorganic fine particles (B) are controlled to be positively chargeable by treating the surface of the inorganic fine particles using a surface treating agent for imparting a positive polarity made of aminosilane.

Also in this case, the inorganic fine particles (A) and inorganic fine particles (B) fulfill each role similar to the case where the toner for non-magnetic monocomponent development has a negative polarity.

In the present invention, the inorganic fine particles (A) and the inorganic fine particles (B) are preferable silica particles (silica particles (A') and silica particles (B'), respectively). The BET specific surface area of the silica particles (A') is preferably within a range from 40 to 90 $m^2/g$ and the BET specific surface area of the silica particles (B') is preferably within a range from 100 to 300 $m^2/g$.

When the BET specific surface area of the silica particles (A') is less than 40 $m^2/g$, the deposition on the toner surface is reduced because the particle diameter is too large. Therefore, black spots are likely to arise on the photosensitive member, and scratching of the surface of the photosensitive member occurs. On the other hand, when the BET specific surface area exceeds 90 $m^2/g$, the charge amount is likely to be reduced, thereby causing fogging in the non-image portion.

When the BET specific surface area of the silica particles (B') is less than 100 $m^2/g$, the effect of improving the fluidity to the toner and charging of the toner is lowered. On the other hand, when the BET specific surface area exceeds 300 $m^2/g$, silica is likely to be embedded in the toner surface, thus causing poor fluidity of the toner. When the amount of the silica particles (B') is increased to cope with the problem, there arises a new problem in that the fixability is lowered.

In the present invention, the weight ratio of the silica particles (A') to the silica particles (B') is preferably within a range from 10:90 to 50:50. When the proportion of the silica particles (B') is less than 50% by weight, it becomes not only difficult to charge the toner in a sufficient charge amount and also to impart sufficient fluidity to supply the toner on a developing roller. On the other hand, when the proportion exceeds 90% by weight, the layer thickness of the toner on the developing sleeve cannot be controlled to be thin and the amount of toner deposited for the latent image by development is too large, and thereby the untransferred toner on the photosensitive member increases.

The amount of inorganic fine particles (A) according to the present invention with respect to the amount of toner particles is preferably 0.1 to 1.0% by weight, and more preferably 0.3 to 0.7% by weight. If the amount of inorganic fine particles is less than 0.1% by weight, the above-explained effects of the inorganic fine particles (A) may not be obtained. If the amount of inorganic fine particles exceeds 1.0% by weight, there is a possibility that a toner having a polarity reverse to a desired polarity is obtained, although this possibility is also affected by the amount of inorganic fine particles (B), and there is a possibility that a member such as the photosensitive member is damaged.

The amount of inorganic fine particles (B) according to the present invention with respect to the amount of toner particles is preferably 0.1 to 2.0% by weight, and more preferably 0.3 to 1.5% by weight. If the amount of inorganic fine particles is less than 0.1% by weight, the above-explained effects of the inorganic fine particles (B) may not be obtained, and there is a possibility that sufficient fluidity and charging property cannot be imparted to the toner particles. If the amount of inorganic fine particles exceeds 2.0% by weight, there is a possibility that free silica contaminates members of the developing device.

The total amount of inorganic fine particles (A) and inorganic fine particles (B) according to the present invention with respect to the amount of toner particles is preferably 0.3 to 2.5% by weight, and more preferably 0.5 to 2.0% by weight. If the total amount of inorganic fine particles (A) and inorganic fine particles (B) is less than 0.3% by weight, there will be cases where the performances of these particles cannot be sufficiently utilized, triboelectric charge amount cannot be evenly imparted to the each toner particles, and it becomes difficult to impart sufficient fluidity to the toner particles. If total amount of inorganic fine particles (A) and inorganic fine particles (B) exceeds 2.5% by weight, there is a possibility that fixibility is lowered, and free silica contaminates members of the developing device.

The adhering of the external additive on the toner particles may be conducted by mixing the toner particles with the external additive in a predetermined ratio, charging the mixture in a stirring device such as Henschel mixer, and depositing the fine particles in the state where the surface of the toner particles are covered with the mixture, or by charging both particles in a surface modifier such as a "NARA Hybridizer", stirring them, and depositing the fine particles by embedding a part of each external additive particle in the surface of the toner particles.

The present invention is applicable not only to toners produced by a melt-kneading-pulverizing method but also to toners produced by other methods such as a polymerization method.

EXAMPLE AND COMPARATIVE EXAMPLES

The following Example and Comparative Examples further illustrate the present invention in detail. In Example and Comparative Examples, parts are by weight unless otherwise specified. The present invention is not limited to the following Example.

EXAMPLE

According to the following formulation, materials were mixed in a super mixer, melt-kneaded with heating at 165° C. using a twin-screw extruder, finely pulverized in a jet mill, and then classified by an dry air-flow type classifying machine to obtain negatively chargeable toner particles having a volume-average particle diameter of 9 $\mu$m.

| | |
|---|---|
| Polyester resin (Mw: $4.28 \times 10^4$, Mn: $0.434 \times 10^4$, acid value: 6.0 mg KOH/g) | 90 Parts |
| Polypropylene wax (manufactured by Sanyo Chemical Industries, Ltd., under the trade name "VISCOL 550P") | 2 Parts |
| Carbon black (manufactured by Mitsubishi Chemical Corporation under the trade name #40) | 7 Parts |
| Negatively chargeable charge control agent, metal-containing dye (manufactured by Orient Chemical Industries, Ltd., under the trade name BONTORON S34) | 1 Part |

The toner particles were mixed with 0.5% by weight of silica particles (A') (BET specific surface area: 50 $m^2/g$), so as to be positively chargeable, by a surface treatment with aminosilane and dimethylpolysiloxane, followed by stirring using a Henschel mixer for 5 minutes. The mixture was mixed with 1% by weight of negatively chargeable silica particles (B') (manufactured by Nippon Aerosil Co. Ltd., under the trade name R-972, BET specific surface area: 130 $m^2/g$), followed by stirring again using a Henschel mixer for 5 minutes to obtain a toner for non-magnetic monocomponent development of the present invention.

Comparative Example 1

In the same manner as in the Example, except that silica particles (A') were not added, a comparative toner for non-magnetic monocomponent development was obtained.

Comparative Example 2

In the same manner as in the Example, except that silica particles (BET specific surface area: 50 $m^2/g$) surface-treated with only aminosilane were added in place of the silica particles (A'), a comparative toner for non-magnetic monocomponent development was obtained.

Comparative Example 3

In the same manner as in the Example, except that silica particles (BET specific surface area: 50 $m^2/g$) surface-treated with only dimethylpolysiloxane were added in place of the silica particles (A'), a comparative toner for non-magnetic monocomponent development was obtained.

The toners for non-magnetic monocomponent development obtained in the Example and Comparative Examples were set in a laser printer (commercially available product; printing rate: A4 in lateral direction, 20 sheets/minute) as a non-magnetic monocomponent developing device which has a negative charging organic photosensitive member and has no mechanism for cleaning the photosensitive member, and then the following properties were evaluated under three environmental atmospheres (normal temperature/normal humidity (N/N): 25° C./50% RH, low temperature/low humidity (L/L): 10° C./20% RH, and high temperature/high humidity (H/H): 30° C./80% RH). The evaluation procedures were as follows.

(1) Image Density

Image density was determined by a MacBeth reflection densitometer RD-914.

(2) Surface Fogging on Photosensitive Member

The surface fogging on the photosensitive member was determined in the following manner. That is, a toner on the non-image portion on the photosensitive member before being transferred onto a transfer paper, is deposited on a transparent tape and the tape is stuck on a white paper, and then the density of the toner on the tape is measured by the MacBeth reflection densitometer RD-914.

(3) Black Solid Reproducibility

The black solid reproducibility was determined by visually evaluating the black solid image portion. Samples with no unevenness in image density were rated good (○), samples with slight unevenness were rated ordinary (Δ), and samples with severe unevenness were rated poor (X).

(4) Ghosting

The ghosting was determined in the following manner. That is, three black solid images of a 3 cm square were printed in a line and ghosting the black solid images, which appears in a cycle corresponding to the circumference of the photosensitive member, was measured by the MacBeth reflection densitometer RD-914. A difference between an average value of data measured at three points and a reflection density of a blank paper was taken as a measured value.

Properties (1) to (4) were evaluated with respect to the images for evaluating the each properties which were printed immediately after printing 10 sheets (image at 5% printing ratio) for initial properties, and after continuously printing 10,000 sheets.

(5) Average Consumption of Toner

The average amount of toner consumed for printing 1,000 sheets was determined in the following manner. That is, a net consumption amount was calculated from the reduction in weight of a toner cartridge after printing 10,000 sheets compared to the weight of the toner cartridge before the beginning of printing, and then the average amount of toner consumed for printing 1,000 sheets was determined by the following equation.

$$\text{Average amount of toner consumed (g/1,000 sheets)} = \text{Total amount of toner consumed (g)}/10$$

The results obtained by measuring the image density, surface fogging on photosensitive member, black solid reproducibility, ghosting image density which appeared in a cycle corresponding to the circumference of the photosensitive member, and amount of toner consumed under the respective environmental conditions such as N/N, L/L and H/H conditions are shown in Tables 1, 2, and 3.

As is apparent from the evaluation results shown in Tables 1 to 3, the toner for non-magnetic monocomponent development of the present invention is superior in all properties such as image density, surface fogging and black solid reproducibility with less ghosting and lower toner consumption under all environmental conditions such as N/N, L/L and H/H conditions from the initial stage through the stage after printing 10,000 sheets when applied to a non-magnetic monocomponent developing device. The toners of Comparative Examples 1, 2, and 3 were inferior in black solid reproducibility and ghosting after printing 10,000 sheets. Furthermore, the toners of Comparative Examples 1 and 2 were inferior in surface fogging, and the occurrence of ghosting was confirmed.

TABLE 1

| | Initial | | | | After printing 10,000 sheets | | | | |
|---|---|---|---|---|---|---|---|---|---|
| N/N | Image density | Surface fogging | Black solid reproducibility | Ghosting image density | Image density | Surface fogging | Black solid reproducibility | Ghosting image density | Average consumption (g/1000 sheets) |
| Example | 1.38 | 0.10 | ○ | 0.00 | 1.43 | 0.09 | ○ | 0.00 | 24 |
| Comp. Example 1 | 1.36 | 0.13 | ○ | 0.03 | 1.40 | 0.12 | Δ | 0.04 | 27 |
| Comp. Example 2 | 1.31 | 0.15 | ○ | 0.02 | 1.39 | 0.13 | Δ | 0.02 | 31 |
| Comp. Example 3 | 1.43 | 0.11 | ○ | 0.00 | 1.47 | 0.10 | Δ | 0.01 | 32 |

TABLE 2

| | Initial | | | | After printing 10,000 sheets | | | | |
|---|---|---|---|---|---|---|---|---|---|
| L/L | Image density | Surface fogging | Black solid reproducibility | Ghosting image density | Image density | Surface fogging | Black solid reproducibility | Ghosting image density | Average consumption (g/1000 sheets) |
| Example | 1.32 | 0.09 | ○ | 0.00 | 1.42 | 0.09 | ○ | 0.00 | 22 |
| Comp. Example 1 | 1.27 | 0.11 | ○ | 0.07 | 1.40 | 0.10 | Δ | 0.05 | 25 |
| Comp. Example 2 | 1.28 | 0.14 | ○ | 0.03 | 1.35 | 0.13 | ○ | 0.02 | 30 |
| Comp. Example 3 | 1.30 | 0.10 | ○ | 0.02 | 1.45 | 0.09 | ○ | 0.01 | 29 |

TABLE 3

| | Initial | | | | After printing 10,000 sheets | | | | |
|---|---|---|---|---|---|---|---|---|---|
| H/H | Image density | Surface fogging | Black solid reproducibility | Ghosting image density | Image density | Surface fogging | Black solid reproducibility | Ghosting image density | Average consumption (g/1000 sheets) |
| Example | 1.42 | 0.13 | ○ | 0.00 | 1.44 | 0.11 | ○ | 0.00 | 28 |
| Comp. Example 1 | 1.41 | 0.16 | Δ | 0.02 | 1.43 | 0.13 | X | 0.02 | 32 |
| Comp. Example 2 | 1.37 | 0.21 | ○ | 0.04 | 1.41 | 0.18 | X | 0.02 | 37 |
| Comp. Example 3 | 1.44 | 0.13 | Δ | 0.01 | 1.49 | 0.12 | Δ | 0.01 | 34 |

What is claimed is:

1. A toner for non-magnetic monocomponent development, comprising toner particles and an external additive adhered on the surface of the toner particles, wherein the external additive comprises, silica particles (A'), which are surface-treated with aminosilane and dimethylpolysiloxane, have a polarity reverse to that of the toner, and have a BET specific surface area within a range from 40 to 90 $m^2/g$, and silica particles (B') having the same polarity as that of the toner and having a BET specific surface area within a range from 100 to 300 $m^2/g$.

2. The toner for non-magnetic monocomponent development according to claim 1, wherein a weight ratio of the silica particles (A') to the silica particles (B') is within a range from 10:90 to 50:50.

3. The toner for non-magnetic monocomponent development according to claim 1, wherein with respect to the amount of toner particles, the amount of the silica particles (A') is 0.1 to 1.0% by weight, the amount of the silica particles (B') is 0.1 to 2.0% by weight, and the total amount of the silica particles (A') and the silica particles (B') is 0.3 to 2.5% by weight.

4. The toner for non-magnetic monocomponent development according to claim 1, wherein the toner particles are negatively chargeable.

* * * * *